United States Patent [19]

Clough et al.

[11] Patent Number: 4,831,782

[45] Date of Patent: May 23, 1989

[54] APPARATUS FOR GRINDING A WORKPIECE

[75] Inventors: Arthur H. Clough, Barre; Edwin L. Knight, Ware; Joseph A. Borbone, Paxton, all of Mass.

[73] Assignee: The Pratt & Whitney Co., Inc., West Hartford, Conn.

[21] Appl. No.: 927,259

[22] Filed: Nov. 4, 1986

[51] Int. Cl.[4] ..... B23B 23/00

[52] U.S. Cl. ..... 51/48 R; 51/105 SP; 51/216 T; 51/237 R; 82/148; 82/149

[58] Field of Search ..... 51/48 R, 49, 105 R, 51/105 SP, 48 R, 216 T, 216 R, 217 T, 238 S, 238 R, 237 CS, 237 R, 165 R, 165.93; 82/31, 32, 38 R

[56] References Cited

U.S. PATENT DOCUMENTS

| | | | |
|---|---|---|---|
| 2,068,915 | 1/1937 | Hardin | 51/238 S |
| 2,710,494 | 6/1955 | Silven . | |
| 2,813,378 | 11/1957 | Hill . | |
| 3,145,513 | 8/1964 | Porath | 51/238 S |
| 3,330,074 | 7/1967 | Stuckey | 51/238 S |
| 3,664,066 | 5/1972 | Clark | 51/49 |
| 4,208,754 | 6/1980 | Hille | 51/49 |
| 4,517,866 | 5/1985 | Bazuin | 51/238 S |

*Primary Examiner*—Frederick R. Schmidt
*Assistant Examiner*—Blynn Shideler
*Attorney, Agent, or Firm*—Raymond J. Eifler; John R. Benefiel

[57] ABSTRACT

An improved grinding apparatus includes a base (100) upon which a headstock (20) is mounted. A carriage (500) is movable along ways (101, 102) disposed on the base. A wheel slide (63) on the carriage rotatably support a grinding wheel (71). A first mounting plate (80) extends beneath a first footstock (400) and a first set of steadyrests (300) to a location adjacent to a headstock (20). While a workpiece is being ground, a second set of steadyrests (300) and a second footstock (400) are mounted on a second mounting plate (80). When the grinding operation has been completed, the first mounting plate is disconnected from the base (100) and removed from the grinding apparatus with the first set of steadyrests (300) and footstock (400). The second mounting plate (80) with the second set of steadyrests (300) and footstock (400) accurately positioned thereon are then inserted into the grinding apparatus.

14 Claims, 6 Drawing Sheets

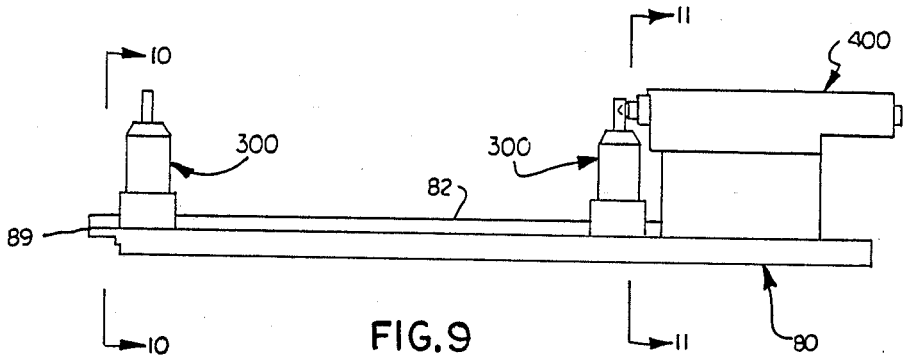
FIG.9
FIG.8
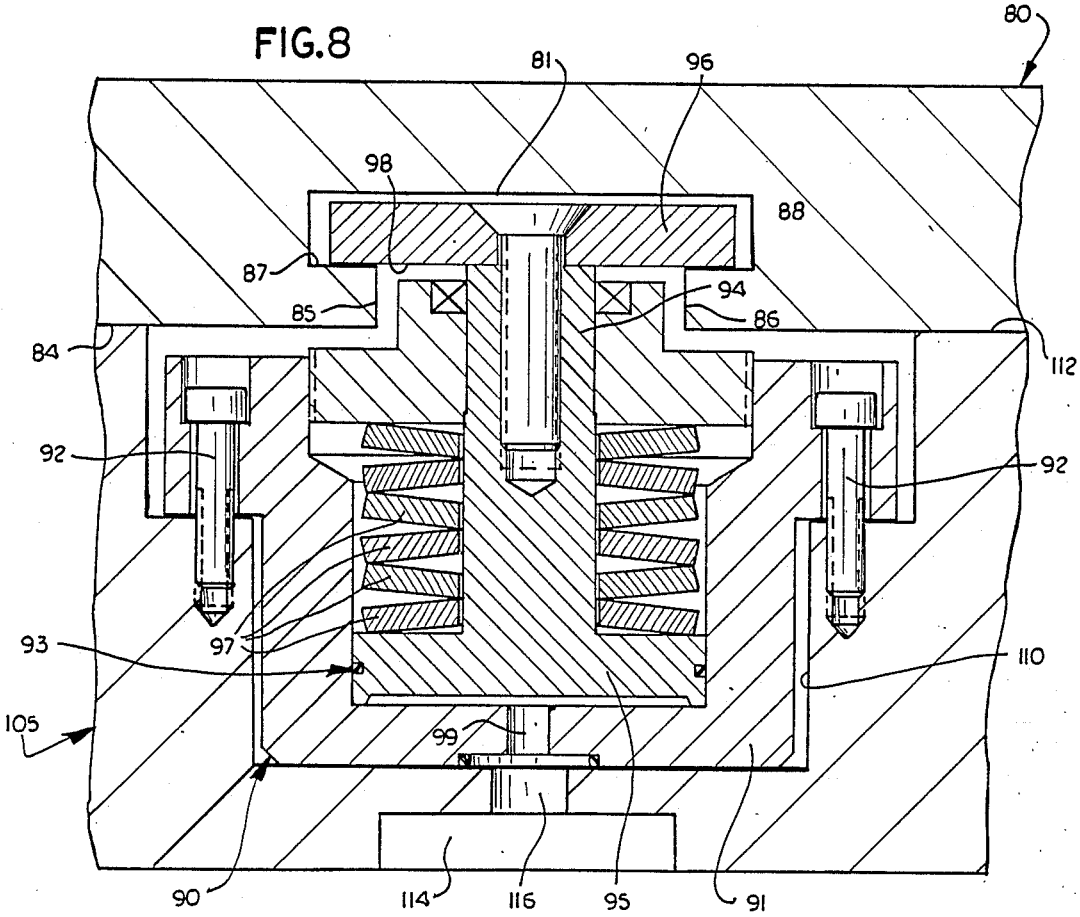

APPARATUS FOR GRINDING A WORKPIECE

This invention relates to an improved apparatus and method for grinding a workpiece and more specifically to a grinding apparatus and method in which a footstock and one or more steadyrests support a workpiece.

A known grinding apparatus includes a base upon which a workpiece is rotatably supported by a headstock and a footstock. A pair of parallel ways are located adjacent to one side of the base guide movement of a carriage. A grinding wheel is rotatably mounted on a wheel slide. The wheel slide is mounted on the carriage and is movable toward and away from the axis of rotation of the workpiece. One example of such an apparatus for grinding a workpiece may be found in U.S. Pat. No. 2,710,494 entitled, Grinding Machine, issued June 14, 1955.

Steadyrests have commonly been used in grinding apparatus to prevent deflection of a workpiece during a grinding operation. The steadyrest must be accurately positioned relative to the workpiece at a location between the headstock and footstock to rotatably support the workpiece. A grinding machine having such a steadyrest is shown in U.S. Pat. No. 2,813,378, entitled Cam Grinding Machine, issued Nov. 19, 1957.

In accordance with a feature of the present invention, one or more steadyrests and a footstock are positioned on a mounting plate at a location spaced from a grinding apparatus. This enables a first workpiece to be ground while the footstock and steadyrests are being positioned on the mounting plate.

Once grinding operations on the first workpiece have been completed, the steadyrests and footstock for the first workpiece are removed from the grinding apparatus. The mounting plate, with the steadyrests and footstock thereon, is then inserted into the grinding apparatus. Once the mounting plate has been accurately positioned relative to a headstock of the grinding apparatus, the mounting plate is securely clamped to a base of the grinding apparatus. By setting up the steadyrests and footstock on the mounting plate at a remote location while the grinding apparatus is being operated to grind a workpiece, down time is minimized to thereby maximize production.

The steadyrests may be mounted on the mounting plate in either one of two orientations, depending upon the direction of grinding wheel rotation. Thus, a steadyrest may be mounted on the mounting plate in a first orientation to enable the steadyrest to support a workpiece during rotation of a grinding wheel in a first direction. The steadyrest may also be mounted on the mounting plate in a second orientation which is offset from the first orientation by 180 degrees, to enable the steadyrest to support a workpiece during rotation of the grinding wheel in a second direction. Since the same steadyrest can be used to support a workpiece during rotation of a grinding wheel in either one of two directions, the size of the inventory of steadyrests is reduced.

BRIEF DESCRIPTION OF THE DRAWINGS

FIG. 8 is an enlarged fragmentary sectional view, taken generally along the line 8—8 of FIG. 5, illustrating the manner in which the mounting plate is releasably connected with the base by a clamp assembly;

FIG. 9 is a schematic illustration depicting the manner in which steadyrests and a footstock are mounted on a mounting plate prior to insertion of the mounting plate into the grinding apparatus;

DETAILED DESCRIPTION OF THE INVENTION

Figure 1:
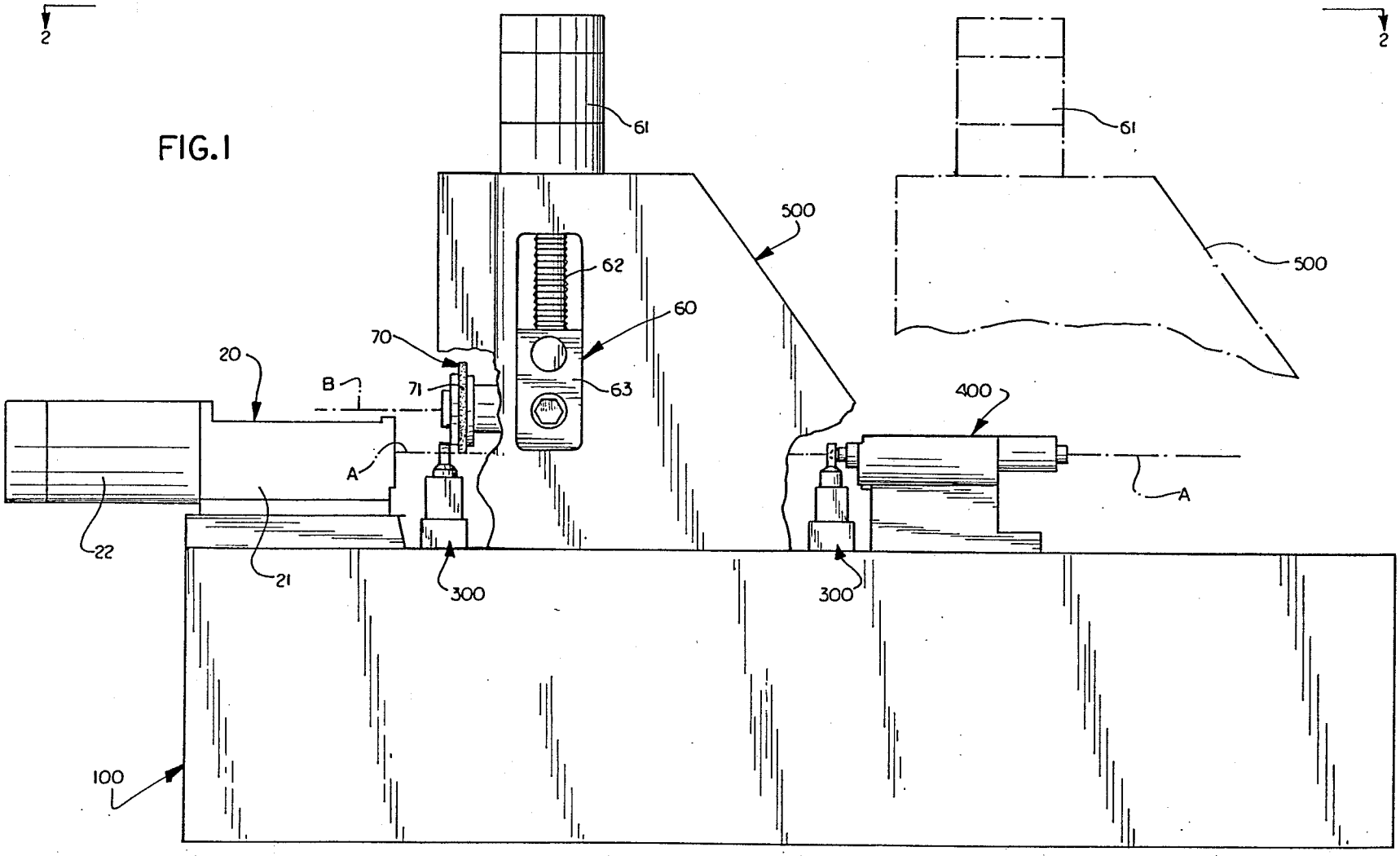
FIG. 1 is a side elevational view of a grinding apparatus and illustrating the relationship between a headstock, a pair of steadyrests, a footstock, a carriage, and a grinding wheel.

Referring now to the drawings, FIG. 1 illustrates a grinding apparatus having a base 100 upon which a headstock assembly 20 is mounted. The headstock assembly 20 is operable to rotate a workpiece supported by the headstock assembly, a pair of steadyrests 300, and a footstock 400. A carriage 500 is movable horizontally along the base 100 from the position shown in solid lines in FIG. 1 to the position shown in dashed lines in FIG. 1. A wheel slide assembly 60 supports a grinding wheel assembly 70 for vertical movement toward and away from horizontal axis A about which a workpiece is rotated.

The headstock assembly 20 includes a spindle 21 which grips one end of a workpiece and is driven by a motor 22 to rotate the workpiece about the horizontal axis A. The opposite end of the workpiece is engaged by the footstock 400 to support the workpiece for rotation about the axis A. Steadyrests 300 are disposed along the axis A between the headstock assembly 20 and the footstock 400. The steadyrests 300 support the workpiece so that it is not deflected under the influence of forces applied against the workpiece by a grinding wheel 71 during a grinding operation.

The grinding wheel assembly 70 includes the grinding wheel 71 which is rotatable about a horizontal axis B. The axis B of rotation of the grinding wheel 71 extends parallel to and is vertically aligned with the axis A about which the workpiece is rotated. The circular grinding wheel 71 has an outside diameter of between six and nine inches.

The wheel slide assembly 60 includes a reversible motor 61 which is connected with a vertically extending drive screw 62. The drive screw 62 is connected with the wheel slide 63. The central axis of the drive screw 62 is located in a vertical plane which contains the axis A of rotation of the workpiece and the axis B of rotation of the grinding wheel 71. Operation of the motor 61 rotates the drive screw 62 to either raise or lower the wheel slide 63 and grinding wheel 71 relative to the axis A of rotation of the workpiece. The carriage 500 is movable along a horizontal path extending parallel to the axis A of rotation of the workpiece to position the grinding wheel 71 relative to the workpiece.

Figure 2:
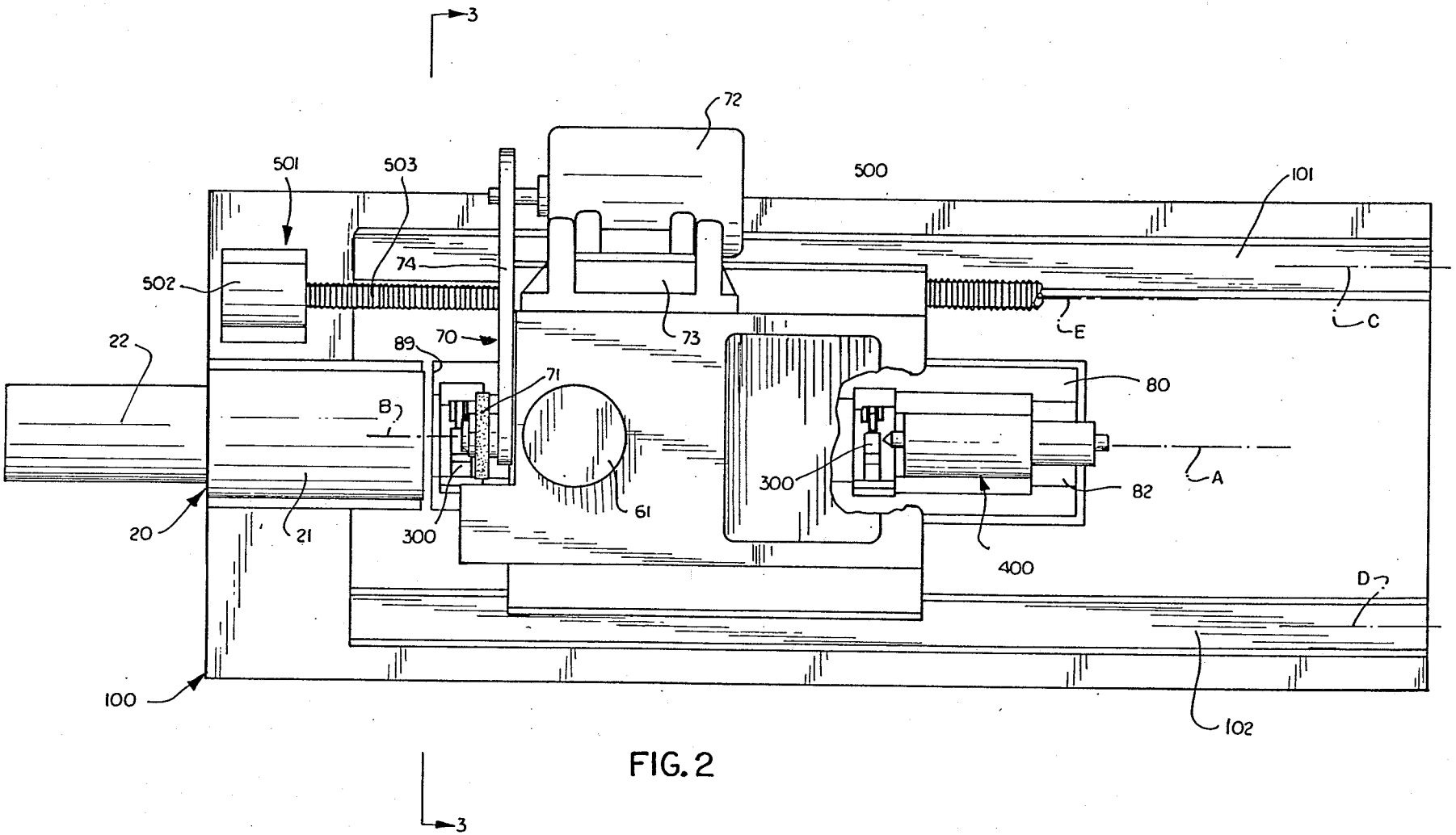
FIG. 2 is a plan view, taken generally along the line 2—2 of FIG. 1, illustrating the relationship between the steadyrests, footstock and a pair of ways for guiding movement of the carriage.

FIG. 2 illustrates a carriage drive assembly 501 which is connected with the carriage 500 and is operable to move the carriage along parallel horizontal guideways 101 and 102 disposed on the base 100. The carriage drive assembly 501 includes a reversible motor 502 which is mounted on the base 100 and is connected with the carriage 500 by a horizontal drive screw 503. The guideways 101 and 102 have horizontal central axes C and D which extend parallel to the horizontal central axis E of the drive screw 503.

Operation of the carriage drive motor 502 in one direction rotates the drive screw 503 to move the carriage 500 leftward, as viewed in FIG. 2, to a position in which the carriage 500 extends past the right steadyrest 300 and encloses the left steadyrest and a portion of the headstock spindle 21. Operation of the motor 71 in the opposite direction rotates the drive screw 503 to move the carriage 500 rightward, as viewed in FIG. 2, to a position in which the carriage 300 encloses the footstock 400.

The grinding wheel assembly 70 includes a reversible motor 72 which is pivotally connected to a bracket 73 fixed to the carriage 500. A drive belt 74 is driven by the motor 72 and transmits drive forces to the grinding wheel 71. As the belt 74 is driven by the motor 72, the grinding wheel 71 is rotated about the horizontal axis B to grind the workpiece as it rotates about the axis A. Since the motor 72 for driving the grinding wheel 71 is mounted on the carriage 500, the weight of the motor does not add to the weight which must be moved with the wheel slide 63.

The parallel axes C and D of the ways 101 and 102 are disposed in a single horizontal plane. The horizontal plane containing the axes C and D is intersected by a vertical plane containing the parallel axes A and B of rotation of the workpiece and grinding wheel at a location midway between the guideway axes C and D. The guideway axes C and D extend parallel to the axes A and B of rotation of the workpiece and grinding wheel.

In accordance with a feature of the present invention, the steadyrests 300 and footstock 400 are disposed on a mounting plate 80 which is releasably connected to the base 100. Upon completion of a grinding operation on a workpiece having one particular configuration, the mounting plate 80 is released for movement relative to the base 100. The mounting plate 80 is then moved axially rightward (as viewed in FIG. 2) away from the headstock assembly 20 and removed from the grinding apparatus. Of course, the steadyrests 300 and footstock 400 are removed from the grinding apparatus with the mounting plate 80. A second mounting plate 80 with steadyrests 300 and a footstock 400 mounted thereon is then inserted into the grinding apparatus.

Once the second mounting plate 80 has been accurately positioned relative to the headstock assembly 20, it is clamped in place. The steadyrests 300 and footstock 400 on the second mounting plate 80 are accurately positioned relative to the mounting plate. Therefore, the steadyrests 300 and footstock 400 are in the proper locations relative to the headstock assembly 20 to support a workpiece having a configuration different from the configuration of the previously ground workpiece. Since the second mounting plate 80 was set up at a remote location during operation of the grinding apparatus, the time required to change from the grinding of a workpiece having one configuration to the grinding of a workpiece having another configuration is minimized to thereby tend to maximize production.

Figure 3:
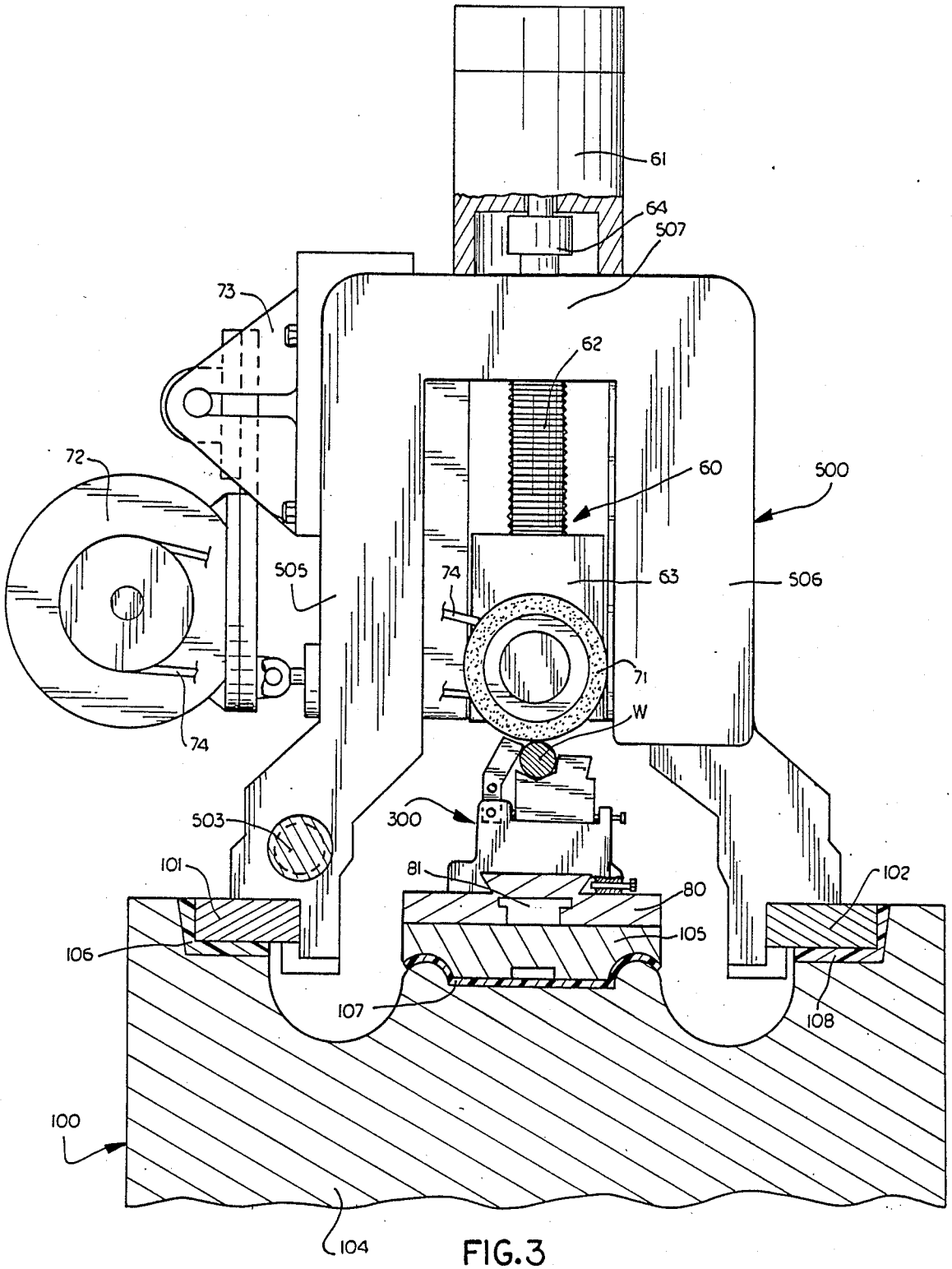
FIG. 3 is an enlarged fragmentary elevational view, taken generally along the line 3—3 of FIG. 2, illustrating the relationship of a mounting plate and steadyrest to the carriage and grinding wheel.

FIG. 3 further illustrates the construction of the carriage 500 which extends upwardly from the base 100. The carriage 500 has a pair of vertical legs 505 and 506 which are interconnected by a horizontal connector section 507. The legs 505 and 506 and connector section 507 result in a carriage 500 having an upside-down U-shaped cross sectional configuration in a vertical plane extending perpendicular to the horizontal axis of rotation of the workpiece W. The legs 505 and 506 flare outwardly at their lower end portions to increase the stability of the carriage 500. The workpiece W has a maximum diameter of six inches.

The carriage 500 is supported on the horizontal guideways 101 and 102 which are disposed on opposite sides of the axis of rotation of the workpiece W and extend parallel to the axis of rotation of the workpiece. The guideways 101 and 102 are each disposed the same distance from a vertical plane which contains the axes of rotation of the workpiece W, the grinding wheel 71 and the drive screw 62. Since the carriage 500 spans the work area where operating forces are generated by engagement of the grinding wheel 71 with the workpiece W, operating forces are transmitted in a balanced manner by the vertical carriage legs 505 and 506 to the guideways 101 and 102.

The wheel slide 63 is movable along a vertical path extending perpendicular to the axis of rotation of the workpiece W by operation of the drive motor 61. The drive motor 61 is mounted on the connector section 507 of the carriage and is connected with the wheel slide 63 by the drive screw 62 through a coupling 64. The axis of rotation of the drive screw 62 extends perpendicular to the parallel axes of rotation of the workpiece W and grinding wheel 71.

The base 100 includes a massive main section 104 and a relatively small subsection 105 to which the mounting plate 80 is releasably connected. The main section 104 of the base 100 is used in a rough or as cast condition. The guideways 101 and 102 and subsection 105 of the base are accurately positioned relative to each other on the main section 104 of the base by cast-in-situ bodies 106, 107 and 108 of material which are disposed between the main section 104 of the base 100 and the guideways 101 and 102 and subsection 105. Although the bodies 106, 107 and 108 of cast-in-situ material can be formed of many different known materials, it is preferred to use "Sikadur 42" (Trademark) structural adhesive which is commercially available from Sika Corporation and is an epoxy resin with sand and/or quartz aggregate fillers.

The cast-in-situ bodies of material 106, 107 and 108 enable the guideways 101 and 102 and subsection 105 to be connected with as cast surfaces of the main section 104 of the base without machining the surfaces. Thus, the cast-in-situ body of material 106 is disposed between the guideway 101 and the main section 104 of the base to accurately position and support the guideway. A slight misalignment between the outer side surfaces of the guideway 101 and the as cast surfaces of the main section 104 of the base is compensated for by the body 106 of cast-in-situ material.

Similarly, the body 108 of cast-in-situ material extends between the outer side surfaces of the guideway 102 and the main section 104 of the base 100 to accurately position and support the guideway 102 on the main section 104 of the base. The cast-in-situ bodies of material 106 and 107 extend throughout the entire length of the guideways 101 and 102 and enable the guideways to be accurately positioned on the as cast main section 104 of the base with their central axes C and D (FIG. 2) parallel to each other in a common horizontal plane.

The body 107 of cast-in-situ material is disposed between the lower side of the subsection 105 and the main section 104 of the base 100. The body 107 of cast-in-situ material cooperates with an as cast surface area on the main section 104 on the base 100 and the lower side of the subsection 105. The body 107 of cast-in-situ material accurately positions the subsection 105 of the base relative to the guideways 101 and 102 and securely holds the subsection in place during operation of the grinding apparatus. The accurate positioning of the subsection 105 of the base relative to the guideways 101 and 102 assures that the mounting plate 80, upon which the steadyrests 300 and footstock 400 (FIG. 2) are disposed, is accurately located relative to the guideways 101 and 102 along which the carriage 500 moves.

Figure 4:
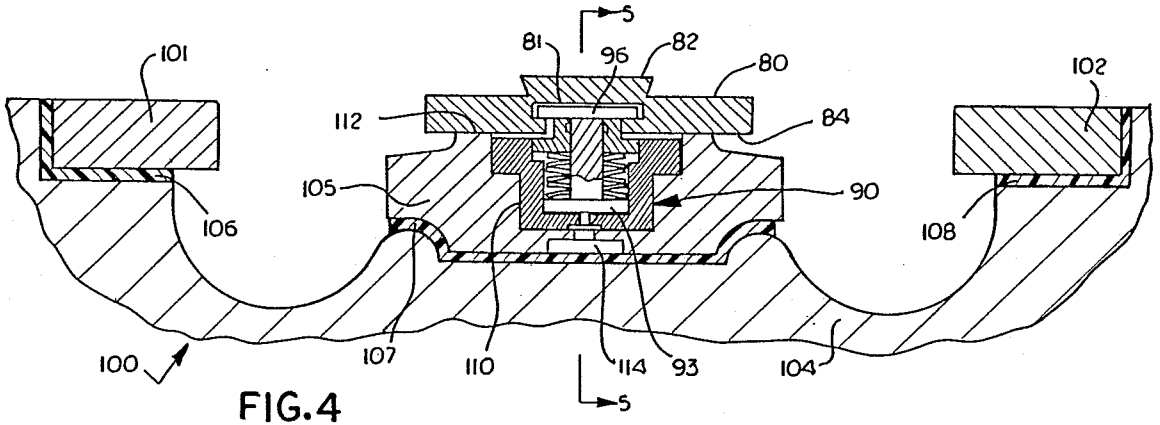
FIG. 4 is fragmentary sectional view illustrating the relationship between the ways, a mounting plate, and a clamp assembly for releasably connecting the mounting plate to the base of the grinding apparatus.

FIG. 4 illustrates the relationship between the guideways 101 and 102, subsection 105 of the base 100, the mounting plate 80, and a clamp assembly 90 which releasably holds the mounting plate 80 against movement relative to the base 100. The clamp assembly 90 is disposed in a cylindrical opening 110 in the subsection 105 of the base and is fixedly connected to the subsection of the base. The clamp assembly 90 has a vertical central axis which intersects the axes A and B about which the workpiece W and grinding wheel 71 rotate.

The clamp assembly 90 extends upwardly through an upper side surface 112 of the base subsection 105 and a lower side surface 84 of the mounting plate 80 into a generally T-shaped slot 81 in the mounting plate. The clamp assembly 90 engages the slot 81 to firmly pull the mounting 80 downwardly against the subsection 105 of the base to hold the mounting plate 80 against movement relative to the base 100 and guideways 101 and 102.

The mounting plate 80 has a dovetail track 82 which extends throughout the length of the mounting plate. When the mounting plate 80 is clamped into position on the subsection 105 of the base, the track 82 extends parallel to and is disposed midway between the guideways 101 and 102.

Figure 5:
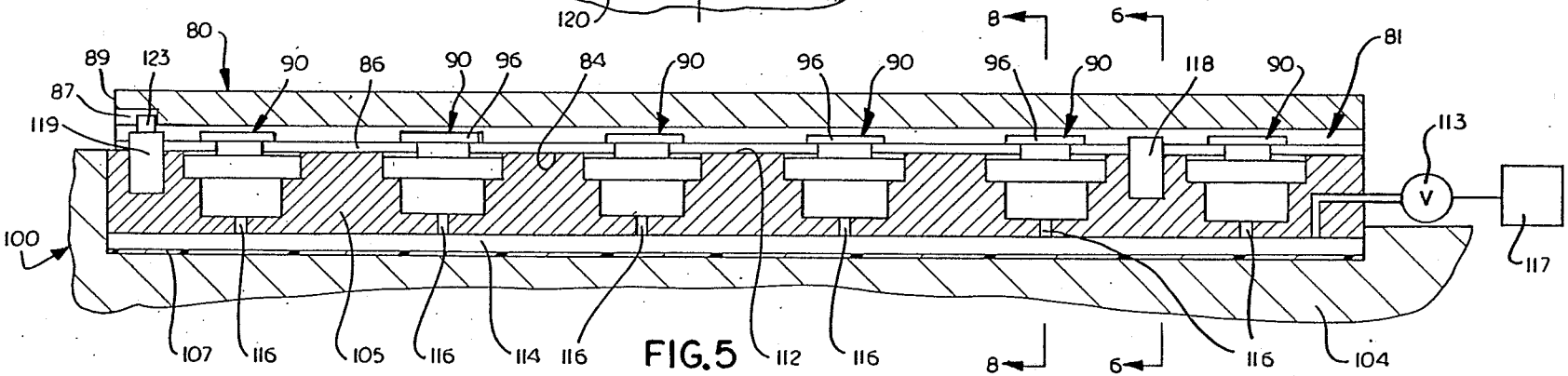
FIG. 5 is a fragmentary sectional view, taken generally along the line 5—5 of FIG. 4, illustrating the relationship between the mounting plate and a plurality of clamp assemblies.

FIG. 5 illustrates how a plurality of the clamp assemblies 90 are mounted in the subsection 105 of the base and engage the mounting plate 80 to firmly hold the mounting plate against movement relative to the base 100. A linear array of the clamp assemblies 90 extends along the central axis of the base subsection 105. The clamp assemblies 90 have vertical central axes which are disposed in the same vertical plane as the axes A and B about which the workpiece W and grinding wheel 71 rotate.

Each of the clamp assemblies 90 engages the slot 81 in the mounting plate 80 to pull the flat bottom surface 84 of the mounting plate 80 firmly downwardly against the flat upper surface 112 of the subsection 105 of the base. The force applied by the clamp assemblies 90 at equally spaced apart locations along the length of the mounting plate 80, holds the mounting plate against movement relative to the subsection 105 of the base.

The clamp assemblies 90 can be simultaneously actuated to release the mounting plate 80 for movement relative to the subsection 105 of the base. The clamp assemblies 90 are connected in fluid communication with a valve 113 which is operable to direct high pressure fluid to the clamp assemblies 90 to release the clamp assemblies. Thus, each of the clamp assemblies 90 is connected in fluid communication with a passage 114 by a passage 116. The passage 114 extends throughout the length of the subsection 105.

When the clamp assemblies 90 are engaged to hold the mounting plate 80 against movement relative to the subsection 105, the valve 113 exhausts the passages 114 and 116 to drain or tank. When the mounting plate 80 is to be released for withdrawal from the grinding apparatus, controls 117 actuate the valve 113 to direct high pressure fluid to the passages 114 and 116. This high pressure fluid actuates the clamp assemblies 90 to a disengaged condition in which the mounting plate 80 can be moved toward the right (as viewed in FIG. 5) to be withdrawn from the grinding apparatus.

When the mounting plate 80 is inserted into the grinding apparatus, the valve 113 is actuated to operate the clamp assemblies 90 to their disengaged conditions. The mounting plate 80 is then slid leftwardly (as viewed in FIG. 5) along the horizontal upper side surface 112 of the subsection 105.

After the first clamp assembly 90 at the right end of the linear array of clamp assemblies has engaged the slot 81, the slot is engaged by a locating pin 118 to position the mounting plate 80 transversely relative to the base 100. As the leftward (as viewed in FIG. 5) movement of the mounting plate continues, each of the clamp assemblies 90 in turn moves into engagement with the slot 81. As the mounting plate 80 approaches a position in which it is to be clamped to the subsection 105 of the base, the mounting plate engages a second locating pin 119.

The locating pin 119 cooperates with the slot 81 to further hold the mounting plate 80 against sideward movement relative to the subsection 105 of the base. Since the locating pin 118 is disposed adjacent to the right (as viewed in FIG. 5) end portion of the mounting plate 80 and the locating pin 119 is disposed adjacent to the left (as viewed in FIG. 5) end portion of the mounting plate, the two locating pins are effective to hold the mounting plate against both rotational and sideward shifting movement relative to subsection 105 of the base.

Figure 6:
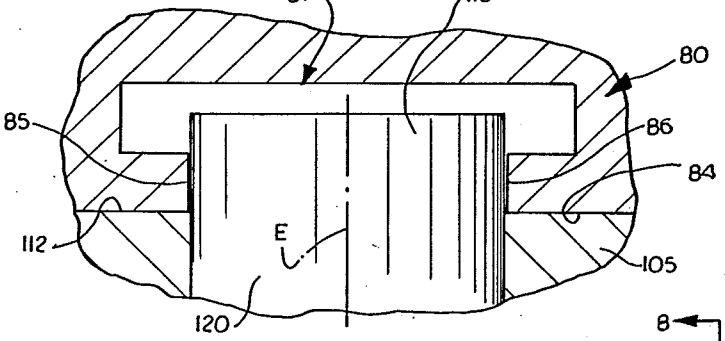
FIG. 6 is an enlarged fragmentary sectional view, taken generally along the line 6—6 of FIG. 5, illustrating the relationship of the mounting plate to a first locating pin.

FIG. 6 illustrates the manner in which the locating pin 118 cooperates with the slot 81 to position the mounting plate 80 relative to the subsection 105 of the base. The slot 81 has a pair of parallel side surfaces 85 and 86 which extend throughout the length of the mounting plate 80 and engage a cylindrical outer side surface 120 of the locating pin 118. The diameter of the cylindrical outer side surface 120 of the locating pin 118 is only very slightly smaller than the distance between the parallel side surfaces 85 and 86 of the slot 81. Therefore, the pin 118 cooperates with the side surfaces 85 and 86 of the slot 81 to accurately position the engaged portion of the side surfaces 85 and 86 relative to the subsection 105 of the base.

The left locating pin 119 (FIG. 5) cooperates with the longitudinally extending parallel side surfaces 85 and 86 of the slot 81 in the same manner as the right locating pin 118. Therefore, the two locating pins 118 and 119 cooperate with the side surfaces 85 and 86 to hold the mounting plate 80 against transverse movement relative to the subsection 105 of the base.

Figure 7:
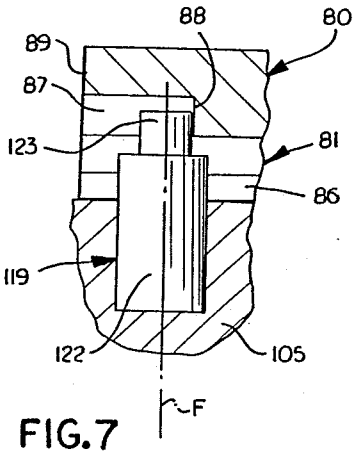
FIG. 7 is an enlarged fragmentary sectional view of a portion of FIG, 5, illustrating the relationship of the mounting plate to a second locating pin.

FIG. 7 illustrates the manner in which the left locating pin 119 cooperates with the slot 81 in the mounting plate 80 to limit leftward (as viewed in FIG. 5) movement of the mounting plate 80 relative to the subsection 105 of the base. Therefore, the locating pin 119 determines the location of the mounting plate 80 along the axis of rotation A (FIG. 2) of the workpiece and the position of the mounting plate, steadyrests 300 and footstock 400 relative to the headstock assembly 20. Thus, the two locating pins 118 and 119 cooperate with the slot 81 in the mounting plate 80 to position the mounting plate transversely and longitudinally relative to the base 100 and headstock assembly 20 of the grinding apparatus.

The locating pin 119 has a cylindrical outer side surface 122 which cooperates with the side surfaces 85 and 86 of the slot 81 in the same manner as the surface 120 of locating pin 118 (FIG. 6). In addition, the locating pin 119 has a cylindrical head end portion 123 (FIG. 7) which extends upwardly into a rectangular recess 87, formed in the mounting plate 80 adjacent to the left (as viewed in FIG. 5) end 89 of the mounting plate. When the mounting plate 80 has been moved leftwardly (as viewed in FIG. 5) to a desired position relative to the base 100 and headstock assembly 20, a flat end surface 88 of the recess 87 moves into abutting engagement with the cylindrical outer side surface of the head portion 123 on the locating pin 119 (FIG. 7) to block further leftward movement of the mounting plate.

The locating pins 118 and 119 have vertical central axes E and F (FIGS. 6 and 7) which are disposed in the same vertical plane as the axes A and B of rotation of the workpiece W and grinding wheel 71 (FIG. 1). The slot 81 extends along the central axis of the mounting plate 80. Therefore, the central axis of the mounting plate is also in the same vertical plane as the axes of rotation A and B of the workpiece W and grinding wheel 71. This results in the footstock 400 (FIG. 2) being positioned with its central axes coincident with the central axis of the headstock assembly 20.

FIG. 8 illustrates the relationship of a clamp assembly 90 to the mounting plate 80 and the subsection 105 of the base 100. The clamp assembly 90 includes a cylindrical housing 91 which is received in one of the cylindrical openings 110 in the subsection 105 of the base. The housing 91 is fixedly connected with the base subsection 105 by suitable fasteners 92.

A piston 93 has a cylindrical rod 94 which extends vertically upwardly from a cylindrical head portion 95 to a circular gripper member 96 which is received in the T-shaped slot 81 in the mounting plate 80. A plurality of annular belleville springs 97 are disposed between the head portion 95 of the piston 93 and the housing 91. The springs 97 press a flat bottom surface 98 on the gripper member 96 downwardly against flat longitudinally extending inner surfaces 87 and 88 of the slot 81. The surfaces 87 and 88 of the slot are disposed in a common plane and extend parallel to each other throughout the length of the mounting plate 80.

When the clamp assembly 90 is to be operated from the engaged condition to the disengaged condition, against the influence of the springs 97, high pressure fluid flows from the passages 114 and 116 in the base subsection 105 through a passage 99 to the housing 90 to apply fluid pressure against the head end portion 95 of the piston 93. This moves the piston 93 upwardly, as viewed in FIG. 8 to compress the springs 97. As the piston 93 moves upwardly, the bottom surface 98 of the gripper member 96 moves out of engagement of the longitudinally extending surfaces 87 and 88 of the mounting plate 80. This releases the mounting plate 80 for removal from the grinding apparatus.

While the clamp assembly 90 is in the disengaged condition, a second mounting plate 80 can be inserted into the grinding apparatus. Once the second mounting plate has been accurately positioned relative to the base subsection 105, the fluid pressure transmitted through the passages 114, 116 and 99 to the piston 93 is reduced. The springs 97 press the gripper 96 against the surfaces 87 and 88 of the slot 81 in the second mounting plate 80 to firmly clamp the second mounting plate in place.

FIG. 9 illustrates the manner in which the steadyrests 300 and footstock 400 are connected with the mounting plate 80 while the mounting plate is out of the grinding apparatus. During grinding of a series of first workpieces having one configuration, a first set of steadyrests 300 and a first footstock 400 support the first workpieces. While workpieces having the first configuration are ground by operation of the grinding apparatus, a second set of steadyrests 300 and second footstock 400 are mounted on a second mounting plate 80 at a location remote from the grinding apparatus. The second set of steadyrests 300 and second footstock 400 are accurately positioned relative to the second mounting plate 80 at locations determined by the configuration of the second workpieces.

A suitable fixture (not shown) is provided to facilitate mounting the second set of steadyrests 300 and second footstock 400 on the second mounting plate 80 at locations determined by the configuration of the second series of workpieces W to be ground. The second mounting plate 80 is placed in this fixture and the steadyrests 300 are accurately positioned along the track 82 relative to the mounting plate 80. Once the steadyrests 300 have been accurately positioned along the track 82, they are fixedly connected with the mounting plate 80. Similarly, the footstock 400 is accurately positioned along the track 82 and connected with the mounting plate 80.

Once the grinding of workpieces having the first configuration has been completed, the first mounting plate 80 with the first set of steadyrests 300 and footstock 400 thereon is withdrawn from the grinding apparatus. This is accomplished by operating the valve 113 (FIG. 5) to actuate the clamp assemblies 90 to the disengaged condition to release the first mounting plate. The first mounting plate 80 is then moved away from the headstock assembly 20 along a horizontal path extending between the legs 505 and 506 of the carriage 500.

Once the first mounting plate 80 has been removed from the grinding apparatus, tee second mounting plate 80 (FIG. 9) with the second set of steadyrests 300 and second footstock 400 disposed thereon is inserted into the grinding apparatus. Once this has been done, the valve 113 is actuated when the clamps 90 are engaged to clamp the second mounting plate into position relative to the base 100 and headstock assembly 20.

Figure 10:
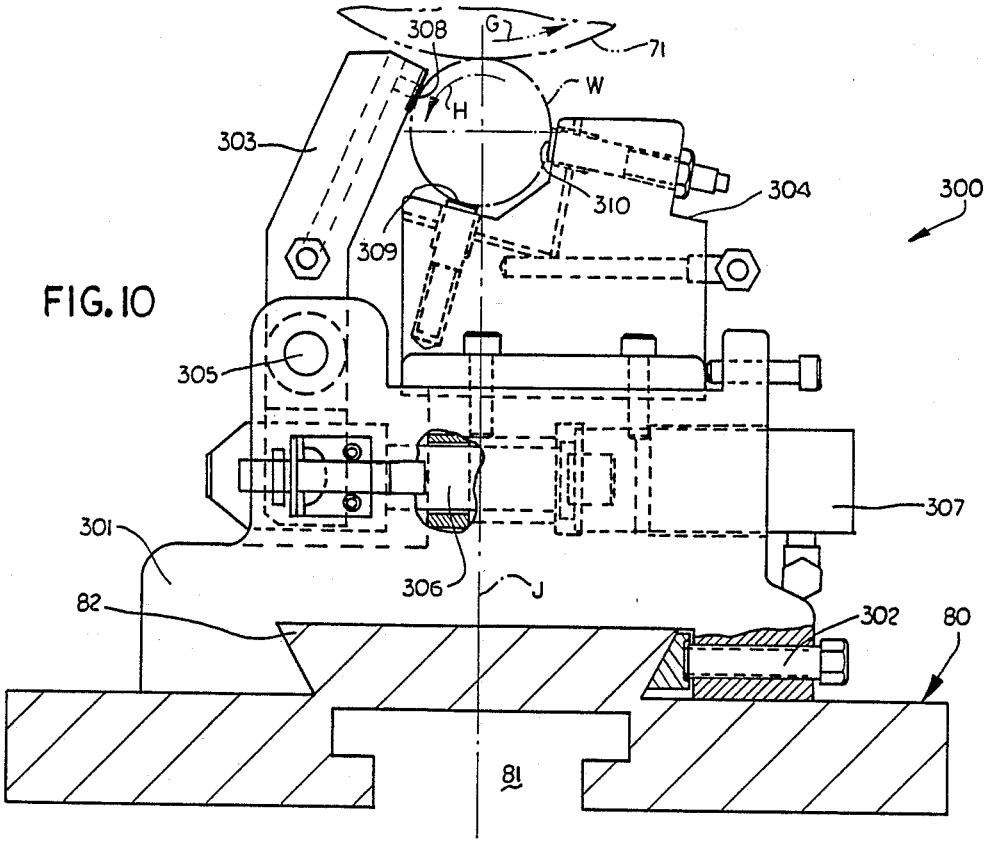
FIG. 10 is an enlarged elevational view, taken generally along the line 10—10 of FIG. 9, illustrating the manner in which a steadyrest is connected with the mounting plate.

The construction of the steadyrest 300 is illustrated in FIG. 10. The steadyrest 300 has a base 301 which is connected with the track 82 on the mounting plate 80 by a clamp assembly 302. The clamp assembly 302 cooperates with the mounting plate track 82 to securely hold the steadyrest 300 is a desired position relative to the mounting plate 80.

The steadyrest 300 has a movable clamp arm 303 which applies pressure against one side of the workpiece W to press the workpiece against a support block 304. The clamp arm 303 is pivotally connected at 305 with the base 301. A piston 306 is operable under the influence of fluid pressure in a cylinder 307 to apply force against the lower end portion of the clamp arm 303. This causes the clamp arm 303 to tend to pivot in a clockwise direction (as viewed in FIG. 10) about the connection 305 to press a clamp arm shoe 308 against the outer side surface of the workpiece W.

Force applied against the workpiece W by the clamp arm shoe 308 presses the outer side surface of the workpiece W against support block shoes 309 and 310. Coolant is conducted to the clamp arm shoe 308 and the support block shoes 309 and 310 through internal passages formed in the clamp arm 303 and the support block 304.

In FIG. 10, the grinding wheel 71 is rotating in a counterclockwise direction, as indicated by the arrow G. The workpiece W is also rotating in a counterclockwise direction, as indicated by the arrow H. It is contemplated that it may be desired to perform grinding operations with the grinding wheel 71 and workpiece W rotating in a clockwise direction, that is, in a direction opposite to the arrows G and H. When this is to be done, the steadyrest 300 is rotated through 180 degrees about its vertical central axis J. The steadyrest 300 is then connected with the track 82 with the clamp arm 303 on the right (as viewed in FIG. 10) side of the track 82 and the mounting block 304 on the left side of the track.

To enable the position of the steadyrest 300 to be reversed to accommodate a change in the direction of rotation of the grinding wheel 71, the vertical central axis J of the steadyrest intersects the horizontal axis A about which the workpiece W rotates. Therefore, when the base 301 of the steadyrest 300 is rotated through 180 degrees about the axis J from the position shown in FIG. 10, the support block shoes 309 and 310 and the clamp arm shoe 308 engage sides of the workpiece opposite from the position shown in FIG. 10. Then, shoes 308, 309 and 310 are now properly positioned relative to the workpiece W to support the workpiece for rotation in a direction opposite from the direction indicated by the arrow H in FIG. 10, that is, in a clockwise direction. Since the same steadyrest 300 can be used to support a workpiece W for either clockwise or counterclockwise rotation, the number of steadyrests which must be kept in inventory is minimized.

Figure 11:
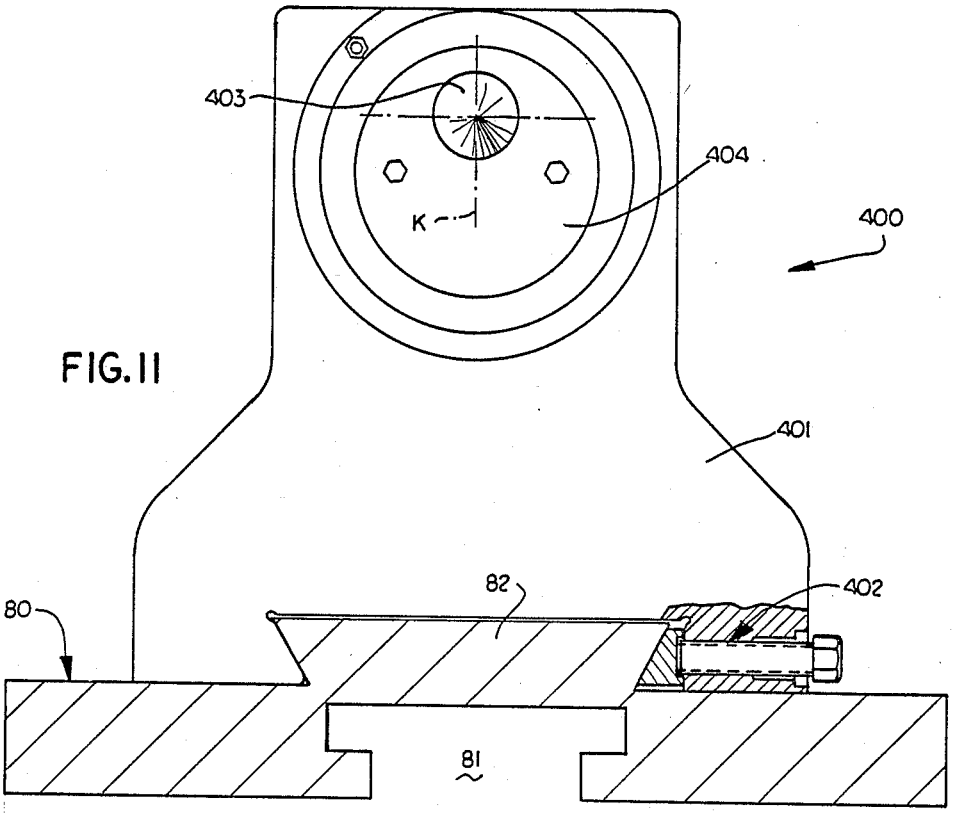
FIG. 11 is an enlarged elevational view, taken generally along the line 11—11 of FIG. 9, illustrating the manner in which the footstock is connected with the mounting plate.

The construction of the footstock 400 is illustrated in FIG. 11. The footstock 400 includes a base 401 which is firmly clamped to the track 82 on the mounting plate 80 by a clamp assembly 402. A workpiece support quill 403 is vertically and horizontally aligned with the central axis of the support plate 80 and the central axis of the headstock assembly 20. Therefore, the vertical central axis K of the quill 403 is disposed in the same vertical plane as the central axis J of the steadyrest and the axes A and B of rotation of the grinding wheel 71 and workpiece W. The quill 403 is supported above the center of a cylindrical mounting section 404. This enables the cylindrical mounting section 404 to provide a solid support for the quill 403.

OPERATION

While a first series of workpieces W are being ground, the first workpieces are supported by a first set of steadyrests 300 and a first footstock 400 positioned on a first mounting plate 80 at locations determined by the configuration of the first workpieces. During operation of the grinding apparatus, a second set of steadyrests 300 and footstock 400 are accurately positioned on a second mounting plate 80 (FIG. 8) at a location spaced from the grinding apparatus. This enables the grinding apparatus to be utilized to grind a first series of workpieces having a first configuration while the second set of steadyrests 300 and second footstock 400 are being positioned on a second mounting plate 80 to support a second series of workpieces having a configuration which is different than the configuration of the first series of workpieces.

Upon completion of grinding operations on the first series of workpieces, the controls 117 actuate the valve 113 (FIG. 5) to direct fluid through the conduits 114 and 116 to each of the clamp assemblies 90. This fluid pressure causes the pistons 93 to compress the springs 97 (FIG. 9) and move the gripper members 96 to disengaged conditions. The first mounting plate 80, with the first set of steadyrests 300 and footstock 400 thereon, is then moved along the base subsection 105 in a direction away from the headstock assembly 20, that is, toward the right as viewed in FIGS. 2 and 5. During withdrawal of the first mounting plate 80 from the grinding apparatus, the mounting plate is slid along the horizontal upper side surface 112 of the subsection 105 of the base. This movement of the first mounting plate 80 is guided by the locating pins 118 and 119 and by the cooperation between the clamp assemblies 90 and the slot 81 in the first mounting plate.

After the first mounting plate 80 has been removed from the grinding apparatus, the next succeeding mounting plate, with the accurately prelocated steadyrests 300 and footstock 400 thereon (FIG. 9) is positioned in the grinding apparatus. Thus, while the clamp assemblies 90 are in the disengaged condition, the flat bottom surface 84 of the second mounting plate 80 is moved into abutting engagement with the upper surface 112 of the subsection 105 of the base. The mounting plate 80 is then slid toward the left (as viewed in FIG. 5). During this movement, the first or rightward clamp assembly 90 engages the slot 81 in the mounting plate. The leading end of the slot 81 then moves into engagement with the right locating pin 118. The cooperation between the cylindrical outer side surface 120 of the locating pin 118 and the side surfaces 85 and 86 of the slot guide further movement of the second mounting plate in a leftward direction (as viewed in FIG. 5) toward the headstock assembly 20.

As the second mounting plate 80 continues to move leftwardly (as viewed in FIG. 5) each of the clamp assemblies 90 in turn moves into engagement with the slot 81. Immediately before the second mounting plate reaches the desired position relative to the headstock assembly 20, the left locating pin 119 moves into engagement with the side surfaces 85 and 86 of the slot 81.

Continued leftward (as viewed in FIG. 5) movement of the mounting plate 80 brings the end surface 88 of the recess 87 (FIG. 7) into abutting engagement with the head end portion 123 of the locating pin 119 to block further movement of the mounting plate. At this time, the clamp assemblies 90 are in the disengaged condition and the second mounting plate 80 is accurately positioned relative to the base 100 and headstock assembly 20 by engagement of the locating pins 118 and 119 with the slot 81.

The control assembly 117 then operates the valve 113 to exhaust the fluid pressure conducted to the clamp assemblies 90. This allows the springs 97 in each of the identical clamp assemblies 90 to press the gripper members 96 firmly downwardly against the longitudinally extending inner side surfaces 87 and 88 (FIG. 9) of the slot 81. The force applied by all of the clamp assemblies 90 against the second mounting plate 80 is sufficient to firmly lock the second mounting plate against movement relative to the base 100. This results in the second set of steadyrests 300 and second footstock 400 being accurately positioned relative to the headstock assembly 20 and ways 101 and 102 along which the carriage 500 moves (FIG. 2).

During insertion and removal of mounting plates 80, the wheel slide 63 (FIG. 3) is raised. This results in the grinding wheel 71 being in a position in which it is above the steadyrests 300 and footstock 400. Therefore, the mounting plates 80, with the steadyrests 300 and footstocks 400 thereon can be moved along a path extending between the legs 505 and 506 of the carriage 500.

The steadyrests 300 may be mounted on the mounting plate 80 in either one of two orientations, depending upon the direction of rotation of the grinding wheel 71. Thus, a steadyrest 300 (FIG. 10) may be mounted on the mounting plate 80 in the orientation shown in FIG. 10 to enable the steadyrest to support a workpiece during rotation of the grinding wheel 71 in a counterclockwise direction. The steadyrest 300 may also be mounted on the mounting plate 80 in a second orientation which is offset from that shown in FIG. 10 by 180 degrees about the axis J. This enables the steadyrest 300 to support a workpiece during rotation of the grinding wheel 71 in a clockwise direction. Since the same steadyrest 300 can be used to support a workpiece W during rotation of a grinding wheel 71 in either direction, the size of the inventory of steadyrests 300 is reduced.

What is claimed is:

1. An apparatus for grinding a workpiece (W), said apparatus comprising a base (100), means (20, 300, 400) for supporting the workpiece for rotation relative to said base, said means for supporting the workpiece including a headstock (20) having an axis of rotation (A), a footstock (400) having an axis of rotation to be aligned with said headstock axis of rotation (A) and at least one steadyrest (300) disposed between the headstock (20) and footstock (400) having work engaging portions (309, 310) adapted to engage a workpiece supported on said headstock axis (A), a pair of ways (101, 102) disposed on said base (100), a carriage (500) movable along said ways, a wheel slide (63) mounted on said carriage (500) and movable toward and away from the axis of rotation (A) of the headstock and a workpiece supported therein, a grinding wheel (71) mounted on said wheel slide for rotation about an axis of rotation (B), said apparatus being characterized by:

a mounting plate (80) carrying both said footstock (400) and steadyrest (300) and having a mounting feature 82 extending along a central axis, said steadyrest (300) being movable along the mounting feature 82 of said mounting plate (80) to any one of a plurality of steadyrest positions disposed in a linear array extending parallel to the central axis of said mounting plate (80), first connector means (302) for connecting said steadyrest (300) to said mounting feature 82 of said mounting plate (80) in a selected one of said plurality of steadyrest positions, said footstock (400) being movable along the mounting feature 82 and said central axis of said mounting plate (80) to any one of a plurality of footstock positions disposed in a linear array extending parallel to the central axis of said mounting plate, second connector means (402) for connecting said footstock (400) to said mounting plate in a selected one of said plurality of footstock positions, each one of said footstock positions positioning said axis of rotation of said footstock (400) in the same vertical plane as said central axis of said mounting plate and a predetermined distance above said mounting plate (80) so as to be aligned with said headstock axis (A) when said mounting plate (80) is installed on said base (100), third connector means (90) for releasably connecting said mounting plate (80) to said base (100) with the central axis of said mounting plate (80) extending parallel to the axis of rotation (B) of said grinding wheel (71); and, locating means (llS, 119) fixed to said base (100) engagable with portions (81, 85, 86, 87, 88) of said mounting plate (88) upon installation on said base (100) to precisely locate said mounting plate (80) on said base (100) with said central axis lying in the same vertical plane as said headstock axis of rotation (A), whereby said axis of said footstock (400) is positioned conincidental to said headstock axis (A) and said steadyrest portions (309, 310) are positioned to support a workpiece on said headstock axis (A).

2. An apparatus as set forth in claim 1 wherein said ways (101, 102) are disposed on opposite sides of said mounting plate (80), said carriage (500) extending from one of said ways across said mounting plate to the other of said ways.

3. An apparatus as set forth in claim 1 wherein said third connector means (90) includes a plurality of clamp members (96) and means (97, 93) for moving said clamp members (96) to an engaged condition holding said mounting plate (80) against movement relative to said base (100) and for moving said clamp members (96) to a disengaged condition releasing said mounting plate for movement relative to said base (100) to enable said mounting plate (80) to be connected with and disconnected from said base.

4. An apparatus as set forth in claim 1 wherein said first connector means (302) for connecting said steadyrest (300) to said mounting plate (80) is operable to connect said steadyrest to said mounting plate in a first orientation and is operable to connect said steadyrest to said mounting plate in a second orientation which is offset by 180 degrees from the first orientation, reversible motor means (72) connected with the grinding wheel (71) for rotating the grinding wheel in a first direction when said steadyrest (300) is in the first orientation and for rotating the grinding wheel in a second direction when said steadyrest is in the second orientation.

5. An apparatus as set forth in claim 1 wherein said base (100) includes a flat upwardly facing support surface (112), said mounting plate (80) includes a flat downwardly facing side surface (84) disposed in abutting engagement with said support surface, said third connector means (90) extending through said support and side surfaces (112, 84) to connect said mounting plate with said base.

6. An apparatus as set forth in claim 1 wherein said third connector means (80) includes means for releasably connecting said mounting plate (80) to said base with the central axis of said mounting plate extending parallel to the axis of rotation of said grinding wheel (71).

7. An apparatus as set forth in claim 1 wherein said mounting plate (80) mounting feature (81) includes surface means for defining a slot (81) which extends parallel to the central axis of said mounting plate, said third connector means (90) includes a plurality of clamp members (96) disposed in engagement with said slot (81) and movable relative to said mounting plate (80) between an engaged condition pressing said mounting plate against said base (100) and a disengaged condition in which said clamp members (96) are ineffective to press said mounting plate against said base.

8. An apparatus as set forth in claim 1 wherein said third connector means (90) includes a plurality of piston and cylinder assemblies (91, 93) disposed on said base (100), each of said piston and cylinder assemblies (91, 93) being operable from a first condition to a second condition to connect said mounting plate (80) to said base (100) and being operable from the second condition to the first condition to release said mounting plate (80) for movement relative to said base (100).

9. An apparatus as set forth in claim 8 wherein said third connector means (90) includes means (114, 116) connected with said piston and cylinder assemblies (91, 93) for simultaneously operating said piston and cylinder assemblies from the second condition to the first condition to release said mounting plate (80) for movement relative to said base (100).

10. An apparatus as set forth in claim 8 wherein said third connector means (90) includes spring means (97) connected with said piston and cylinder assemblies (91, 93) for resiliently urging said piston and cylinder assemblies toward the second condition, and means (114, 116) connected with said piston and cylinder assemblies (91, 93) for simultaneously operating said piston and cylinder assemblies from the second condition to the first condition against the influence of said spring means to release said mounting plate (80) for movement relative to said base (100).

11. An apparatus as set forth in claim 1 wherein said steadyrest (300) includes a plurality of support surfaces (309, 310) for engaging the workpiece (W), said first connector means (302) being operable to connect said steadyrest (300) to said mounting plate in a first orientation in which said support surfaces (309, 310) are disposed in a first relationship with a workpiece and being operable to connect said steadyrest to said mounting plate in a second orientation which is offset by 180 degrees from the first orientation, said support surfaces (309, 310) being disposed in a second relationship with the workpiece (W) when said steadyrest (300) is in the second orientation, said second relationship being different than said first relationship.

12. An apparatus for grinding a workpiece (W), said apparatus comprising a base (100), means (20, 300, 400) for supporting the workpiece for rotation relative to said base, said means for supporting the workpiece including a headstock (20), a footstock (400) and a steadyrest (300) disposed between the headstock and footstock, a pair of ways (101, 102) disposed on said base, a carriage (500) movable along said ways, a wheel slide (63) mounted on said carriage and movable toward and away from the axis of rotation of the workpiece, a grinding wheel (71) rotatably mounted on said wheel slide, said apparatus being characterized by a mounting plate (80), means (302, 402) for connecting said steadyrest (300) and footstock (400) to said mounting plate, and connector means (90) for releasably connecting said mounting plate (80) to said base (100), said mounting plate (80) including surface means for defining a slot (81) which extends parallel to a longitudinal central axis of said mounting plate, said connector means (90) including a plurality of clamp members (96) disposed in engagement with said slot (81) and movable relative to said mounting plate (80) between an engaged condition pressing said mounting plate against said base (100) and a disengaged condition in which said clamp members (96) are ineffective to press said mounting plate against said base, said connector means further including a linear array of piston and cylinder assemblies (91, 93) disposed on said base (100), each of said piston and cylinder assemblies (91, 93) being connected with one of said clamp members (96), each of said piston and cylinder assemblies (91, 93) being operable from a first condition to a second condition to move one of said clamp members (96) from the disengaged condition to the engaged condition and being operable from the second condition to the first condition to move one of said clamp members from the engaged condition to the disengaged condition, said connector means further includes spring means (97) connected with said piston and cylinder assemblies (91, 93) for resiliently urging said piston and cylinder assemblies toward the second condition, and conduit means (114, 116) connected in fluid communication with each of said piston and cylinder assemblies (91, 93) for conducting fluid pressure to operate said piston and cylinder assemblies from the second condition to the first condition and move said clamp members (96) from the engaged condition to the disengaged condition to release said mounting plate (80) for movement relative to said base (100).

13. An apparatus as set forth in claim 2 wherein said steadyrest (300) includes a plurality of support surfaces (309, 310) for engaging the workpiece (W), said means (302) for connecting said steadyrest (300) to said mounting plate (80) being operable to connect said steadyrest to said mounting plate in a first orientation in which said support surfaces (309, 310) are disposed in a first relationship with a workpiece and being operable to connect said steadyrest to said mounting plate in a second orientation which is offset by 180 degrees from the first orientation, said support surfaces (309, 310) being disposed in a second relationship with the workpiece when said steadyrest is in the second orientation, said second relationship being different than said first relationship, reversible motor means (72) connected with the grinding wheel (7I) for rotating the grinding wheel in a first direction when said steadyrest (300) is in the first orientation and for rotating the grinding wheel in a second direction when said steadyrest is in the second orientation.

14. An apparatus as set forth in claim 12 wherein said ways (101, 102) are disposed on opposite sides of said mounting plate (80), said carriage (500) extending from one of said ways across said mounting plate to the other of said ways.

* * * * *